US006248014B1

(12) United States Patent
Collier

(10) Patent No.: US 6,248,014 B1
(45) Date of Patent: Jun. 19, 2001

(54) SELF-CONTAINED ACTIVITY MODULE

(76) Inventor: William R. Collier, Suite 411 2120 Sherbrooke East, Quebec (CA), H2K 1C3

( * ) Notice: Subject to any disclaimer, the term of this patent is extended or adjusted under 35 U.S.C. 154(b) by 0 days.

(21) Appl. No.: 09/242,444

(22) PCT Filed: Jul. 17, 1998

(86) PCT No.: PCT/CA98/00699

§ 371 Date: Feb. 17, 1999

§ 102(e) Date: Feb. 17, 1999

(87) PCT Pub. No.: WO99/03376

PCT Pub. Date: Jan. 28, 1999

(30) Foreign Application Priority Data

Jul. 17, 1997 (CA) ..... 2210787

(51) Int. Cl.[7] ..... F24F 7/007

(52) U.S. Cl. ..... 454/228; 454/186; 454/230; 454/231; 454/306

(58) Field of Search ..... 454/185, 186, 454/228, 230, 231, 233, 236, 306

(56) References Cited

U.S. PATENT DOCUMENTS

| | | | |
|---|---|---|---|
| D. 241,386 | 9/1976 | Lawrence | D6/22 |
| D. 327,375 | 6/1992 | Cooper | D6/338 |
| D. 386,916 | 12/1997 | Conner | D6/426 |
| D. 423,828 | 5/2000 | Wilkinson | D6/491 |
| D. 425,321 | 5/2000 | Tholkes et al. | D6/338 |
| 2,210,458 | 8/1940 | Keilholtz . | |
| 2,507,634 * | 5/1950 | Hill | 454/231 |
| 3,744,556 | 7/1973 | Church | 165/57 |
| 3,789,747 | 2/1974 | Wasserman et al. . | |
| 3,856,981 | 12/1974 | Boundy | 174/48 |
| 3,935,898 | 2/1976 | Westergen | 165/22 |
| 4,134,614 | 1/1979 | Fielding, Sr. | 297/156 |
| 4,135,440 | 1/1979 | Schmidt et al. . | |
| 4,272,136 | 6/1981 | Sengua | 312/196 |
| 4,297,940 | 11/1981 | Hainline . | |
| 4,351,475 | 9/1982 | Hudson | 237/46 |
| 4,353,411 | 10/1982 | Harter . | |
| 4,378,727 | 4/1983 | Doss . | |
| 4,625,633 | 12/1986 | Martin . | |
| 4,667,580 * | 5/1987 | Wetzel . | |
| 4,775,001 | 10/1988 | Ward et al. | 165/22 |
| 4,784,445 | 11/1988 | Ott | 312/236 |
| 4,880,270 | 11/1989 | Cooper | 297/188 |
| 4,942,805 | 7/1990 | Hellwig et al. . | |
| 4,974,915 | 12/1990 | Bussard | 312/236 |
| 5,028,016 | 7/1991 | Kelvin et al. | 244/122 R |
| 5,065,668 | 11/1991 | Mitchell et al. . | |
| 5,074,116 | 12/1991 | Kadotani et al. | 62/3.2 |
| 5,151,063 | 9/1992 | Tanaka et al. | 454/258 |
| 5,181,883 | 1/1993 | Hofstra et al. | 454/49 |
| 5,238,452 | 8/1993 | Levy et al. | 454/306 |
| 5,257,957 | 11/1993 | Diccianni et al. | 454/57 |
| 5,263,897 | 11/1993 | Kondo et al. | 454/189 |
| 5,314,376 | 5/1994 | Kuramarohit | 454/186 |

(List continued on next page.)

FOREIGN PATENT DOCUMENTS

| | | | |
|---|---|---|---|
| 0 551 186 | 7/1993 | (EP) . | |
| 2 265 396 | 9/1993 | (GB) . | |
| 564206 * | 6/1957 | (IT) | 454/228 |

*Primary Examiner*—Harold Joyce

(57) ABSTRACT

A self-contained activity module comprises a base assembly, a first service housing and distribution unit positioned on the base comprising walls forming at least one service passage, and a second service housing and distribution unit positioned on the first unit and substantially perpendicular thereto, the second unit spaced upwardly apart from and extending over at least a portion of the base, the second unit further comprising walls forming at least a second service housing and distribution passage positioned in fluid communication with the first service passage.

3 Claims, 16 Drawing Sheets

U.S. PATENT DOCUMENTS

| | | | | |
|---|---|---|---|---|
| 5,322,473 | | 6/1994 | Hofstra et al. | 454/186 |
| 5,350,337 | | 9/1994 | Kondo et al. | 454/189 |
| 5,358,444 | | 10/1994 | Helm et al. | 454/306 |
| 5,403,232 | | 4/1995 | Helm et al. | 454/230 |
| 5,410,120 | | 4/1995 | Taylor | 219/72 |
| 5,424,806 | | 6/1995 | Siegel | 355/200 |
| 5,453,049 | * | 9/1995 | Tillman, Jr. et al. | 454/228 |
| 5,468,184 | | 11/1995 | Collier | 454/186 |
| 5,493,808 | | 2/1996 | Munday | 47/60 |
| 5,496,090 | | 3/1996 | Emmett et al. | 297/240 |
| 5,499,868 | | 3/1996 | Schainholz | 312/236 |
| 5,514,037 | | 5/1996 | Downey, Jr. | 454/345 |
| 5,573,320 | | 11/1996 | Shearer . | |
| 5,624,312 | | 4/1997 | Collier | 454/247 |
| 5,649,997 | | 7/1997 | Cavallero et al. | 95/284 |
| 5,678,907 | | 10/1997 | Schainholz | 312/223.6 |
| 5,687,513 | | 11/1997 | Baloga et al. | 52/32 |
| 5,765,910 | | 6/1998 | Larkin et al. | 297/172 |
| 5,802,778 | | 9/1998 | Thorp et al. | 52/36.2 |
| 5,829,202 | | 11/1998 | Canton Gongora et al. | 52/36.1 |
| 5,868,079 | | 2/1999 | Charny | 108/7 |

* cited by examiner

SELF-CONTAINED ACTIVITY MODULE

FIELD OF THE INVENTION

The present invention relates to a self-contained activity module for supplying seating, work surfaces, equipment supports, and services such as conditioned air and lighting, as well as power, voice, data, and video connections, and the like. The terms "activity module," "work module," "activity station," and "work station," are used interchangeably herein in referring to the invention.

BACKGROUND OF THE INVENTION

Despite the hundreds of variations currently on the market, the basic desk/chair furniture configuration used in office and industrial applications really has not changed all that much since the days of quill pens and sealing wax. This is true despite the fact that for at least thirty years, study after study has documented workers' dissatisfaction with their work environment. Many forms of physical discomfort caused by bad ergonomics, and the inability of the individual to control air conditioning, lighting, or other environmental conditions in his/her immediate vicinity have all conspired to undermine employee morale and decrease productivity.

In large part, worker dissatisfaction is caused by, or is related to, the office furniture they use. Almost every office furniture "system" is an amalgam of unsatisfactory compromises between pieces of equipment that were rarely designed with each other in mind, and virtually never with respect to the way the worker must interact with them as a collective whole.

The widespread incidence of work related repetitive stress injury as well as other musculoskeletal disorders, and the huge jury awards employees have won because of them, are unfortunate results of the dearth of truly integrated, ergonomically designed, office furniture products.

Worker complaints generally fall into seven categories, namely:

1) uncomfortable and unhealthy seating, resulting in fatigue and pain in the back, wrists, elbows, shoulders and neck, as well as limbs falling asleep due to constricted blood circulation;
2) inadequate HVAC system (e.g., too hot, too cold, too drafty, poor air quality);
3) poor lighting (e.g., too dark, too bright, glare, shadows, poor color quality);
4) poor acoustics and noise pollution;
5) obstructed and monotonous sight lines;
6) inconvenient and inadequate storage;
7) lack of control over any of the above.

Of course, some of these problems plaguing the modern office environment have traditionally been considered outside the ambit of furniture design, such as bad ambient lighting or poor air circulation.

But holistic furniture design that truly harmonizes seating, work surfaces, electronic and other equipment, lighting, and air delivery into a unified package can virtually eliminate all these bad conditions. A properly designed furniture system, one that really is a system, can even rescue some of the office buildings that may otherwise be considered obsolete because of the pressures placed on them by increasing heat loads and office population densities.

As appears further herein, the present invention is directed to an improved work station intended to economically, efficiently, and otherwise beneficially address the changing needs of the modern work environment, including the ever increasing use of electronic equipment and the move to the so-called "paperless office." By way of example and not of limitation, the present invention may also be used beneficially in industrial and control room applications, as well as in recreational settings where video, virtual reality, and other hitech entertainments are offered.

Before furnishing a more specific statement of the present invention's objects and a detailed description of its preferred embodiments, it is believed helpful to provide, for purposes of context, an overview of the prior art.

Office furniture designs over the past several decades have been largely derivative. This is why over the years there were no advances in the field paralleling those in office electronic equipment technology, which of course includes the ubiquitous computer.

Up until the middle of the 20th century people worked in so-called "bank" or "bullpen" type offices wherein people sat at desks having no partition between them. Only supervisors and managers were entitled to separate work spaces, which were created using 66 inch high panels of wood and glass.

During the early 1960's bürolandschaft, or "office landscape," furniture was developed in Germany. Curved acoustical panels, usually 60 inches high, were used to separate individual desks from one another. The concept behind landscape furniture was that by giving workers some privacy, and by creating the illusion that shared common space, (viz., aisle ways), was an extension of their own individual work areas, it would be possible to office more employees in less space.

Shortly thereafter American designers began joining the panels of landscape furniture together, and suspending work surfaces, storage cabinets, and task lighting from them. This was the first "systems furniture." The most common panel heights were 60", 66", and 80" so that each worker was enclosed in a little private work space.

Today, the typical "cubicle" comprises dozens of separate parts that must be assembled on site. In most instances the panels receive through either their base boards (from underfloor or floor level distribution) or upper portions (via "power poles" from the ceiling) power and other electrical connectors, which are routed through the panel interior.

Currently, many offices are being designed using an "open plan" layout. These are actually very much like the bullpen configurations of old. The main difference is that now systems furniture is used, and work surfaces and storage cabinets are suspended from electrified panels that are substantially lower than those used in the past. Proponents of open plan designs maintain that they foster communication and cooperation among workers.

The open plan approach is also popular because it serves another major goal of most businesses, namely, reducing the square footage of office space allocated per worker. The ongoing and dramatic increase in office population densities is driven by the high cost of floor space and the intense pressure on businesses to cut overhead.

But, it can cause major problems for the office environment. Office heat loads are rising as more people and an increasing amount of electronic office equipment are being packed into less and less space. Building air conditioning systems are frequently unable to cope satisfactorily with the cooling demands this creates, and indoor air quality suffers greatly. Attempts to force more and/or colder air through the overhead ducts or under the raised access floor create cold spots and drafts. It can also create noise and, of course, placing employees' work areas closer to one another results in other kinds of acoustic pollution as well.

Systems furniture does not address these problems. Although it was innovative in the 1960's and, because better solutions have not been available it is still widely used, systems furniture is both inflexible and expensive in today's office environment.

In fact, bringing additional electrical capacity to and through such products, and just moving cubicles themselves, have sparked their own industries because of all the difficulties involved. Meeting the logistical challenges represent significant costs because the current office furniture chum rate is at least 25% on average, (i.e., at least 25% of a given office will relocate/reconfigure annually), and in many cases is far higher.

Within the last couple of years, a number of major office furniture companies have introduced "mobile" furniture. Basically, these products comprise tables or desks on wheels from which storage bins can be removably suspended, or that have conventional drawers. The idea is to provide enhanced flexibility for the rapid relocations that take place in the dynamic office environment. Such products may also include adjustable computer monitor supports and/or keyboard platforms, and may provide an extension cord type connector for connecting to an external power source. These adjustable features are aimed at improving the ergonomic performance of the furniture by permitting the user to control the positioning of certain equipment.

Still other currently available products might be described as "offices in a cabinet". Such products may be mounted on casters. The cabinetry opens out into what is in effect a panel system wherein a work surface, shelves, and the like are attached to and suspended from the interior side of the cabinet walls. An electrical connector or connectors may be provided. The concept behind this type of product is to provide a compact, movable, and storable work unit. A limited number of adjustment options may also be offered by these products.

Various specialized desks, such as trading desks, that include supply air grills or similar air outlets have been on the market. Also, an accessory product intended for installation on an existing desk offers control over various conditions such as air flow. It has not been widely received.

There are innumerable office chair products on the market. Many of these are touted to be ergonomically advanced, and certainly design progress has been made over the past few years. Some chairs allow adjustments of many more aspects than others. The common failing of these stand alone chair products is that their manual adjustment controls, including pneumatic ones, are not very user friendly. For this reason, users find it difficult to make good adjustments, and they do not adjust their chairs often enough to maintain an ergonomically healthy seating environment.

OBJECTS AND STATEMENT OF THE INVENTION

Prior art responses to the now universally recognized fact that conventional office furniture does not address the needs of the modern worker or work environment have been based, for the most part, on slight modifications of conventional models that are simply inadequate to the task. The recent efforts to increase work furniture mobility and ergonomic performance, while laudable, do not represent a truly comprehensive approach to the work environment, and thus fail to provide a truly comprehensive solution.

In the light of this, it is a principal object of the present invention to provide an improved, self-contained work, or activity, module having an integrated ergonomic design that affords the occupant the ability to control and to adjust, over a wide range, various constituents of his or her immediate work environment, which constituents may include, e.g., lighting, air circulation, and temperature, as well as seating, and work surfaces.

It is another object of the invention to provide a complete work station environment that includes a support base assembly, a chair positioned on, and movably connected to, the base assembly, and further includes equipment support members and service housing and distribution units positioned on, and supported by, the base assembly, and further wherein at least one of the service housing and distribution units may also serve as an equipment support member.

Another object of the invention is to provide a total work station environment having a base assembly that supports a pivotable disc upon which the chair and at least one of the equipment support members can be mounted and that can be rotated to take advantage of natural light during the work day, or to vary an occupant's sight lines.

It is a still further object of the invention to provide an improved, simplified and modular work station system that can be assembled and installed quickly and without the need for highly skilled or specialized labor.

A still further object of the invention is to provide an improved, simplified work or activity module that can be easily maintained and, where needed, disassembled by regular building maintenance or facilities staffs.

Yet, another object of the invention is to provide an improved work module that can be quickly and easily moved to another location within the facility with minimum disassembly, and with minimum disruption of electrical connections.

Another object of the invention is to provide a total work station environment affording easy connection to, and disconnection from, electrical building services, and the like, whether such services are supplied at ceiling level, at floor level, from under the floor, or from walls, or through a combination of two or more of the above.

Still another object of the invention is to provide a self-contained work station having ample work and storage space, but has a compact footprint.

Another object of the invention is to provide an improved, total work station environment affording high quality lighting easily controlled by the occupant.

Still further, it is an object of the invention to provide a total work station environment affording convenient adjustment of the air change rate in the vicinity of the station.

Further still, it is an object of the invention to provide a total work station environment affording the occupant convenient control of the temperature in the vicinity of the station.

Yet a further object of the invention is to provide a total work station environment affording conditioned air distribution and temperature control in the vicinity of the station through means that do not require being connected to the building conditioned air distribution system.

It is yet another object of the invention to provide an improved total work station environment furnishing ergonomically sound seating designed specifically for use with the station and included as an integral component thereof, and wherein the seating affords the occupant a full range of adjustability, preferably through the use of electronic controls for making at least some adjustments.

Yet another object of the invention is to provide an improved, ergonomically designed work station environment wherein work surfaces are easily adjustable over a wide range of positions by the worker, preferably using electronic controls for at least some adjustments of at least some surfaces.

A still further object of the invention is to provide a total work station environment that promotes energy efficiency, and thereby helps reduce energy consumption and the costs associated therewith, by supplying individual controls for air flow rate, temperature, and lighting, such that those services can easily be shut down or reduced in the module when it is not occupied, and further that permits conditions in the ambient spaces outside a module to be maintained at levels requiring lower energy use than would otherwise be the case.

A further object of the invention is to provide an improved, modular, and energy efficient work station environment wherein lighting, air flow, and temperature levels automatically adjust to a preset energy saving mode when the station has been left unoccupied for a given period.

Still, another object of the invention is to provide an improved modular, total work station environment that eliminates the need for electrified panel systems, while still affording ample and convenient equipment connections to, e.g., power, voice, data and video sources and the like.

Another object of the invention is to provide a modular, compact, work station environment that affords the occupant privacy, but eliminates the need for separate floor mounted panels to furnish it.

It is yet another object of the invention is to provide an improved total work station environment wherein electronic controls permitting adjustment of various work environment conditions, such as seating, work surface position, lighting, air flow, and temperature include a programmable memory such that multiple workers can use the station with their preferences entered into the memory for quick retrieval and adjustment.

Another object of the invention is to provide an improved total work station environment including an overhead canopy member that serves to shield sound, reflect light, and direct air flow.

The exact manner in which the foregoing and other objects and advantages of the invention are carried into practice will become more clearly apparent when reference is made to the following detailed description of the preferred embodiments of the invention set forth by way of example, and shown in the accompanying drawings, wherein like reference numbers indicate corresponding parts throughout. It should be understood that while the descriptions detailed herein indicate the preferred embodiments of the invention, they are given by way of illustration only, and that it is anticipated that certain variations, changes, and modifications may be made to the described structure without departing from the spirit of the invention or the scope of the appended claims.

IN THE DRAWINGS

FIG. 6 is a longitudinal cross-sectional view of the base assembly taken along lines 6—6 of FIG. 5;

DESCRIPTION OF PREFERRED EMBODIMENTS

Figure 1:
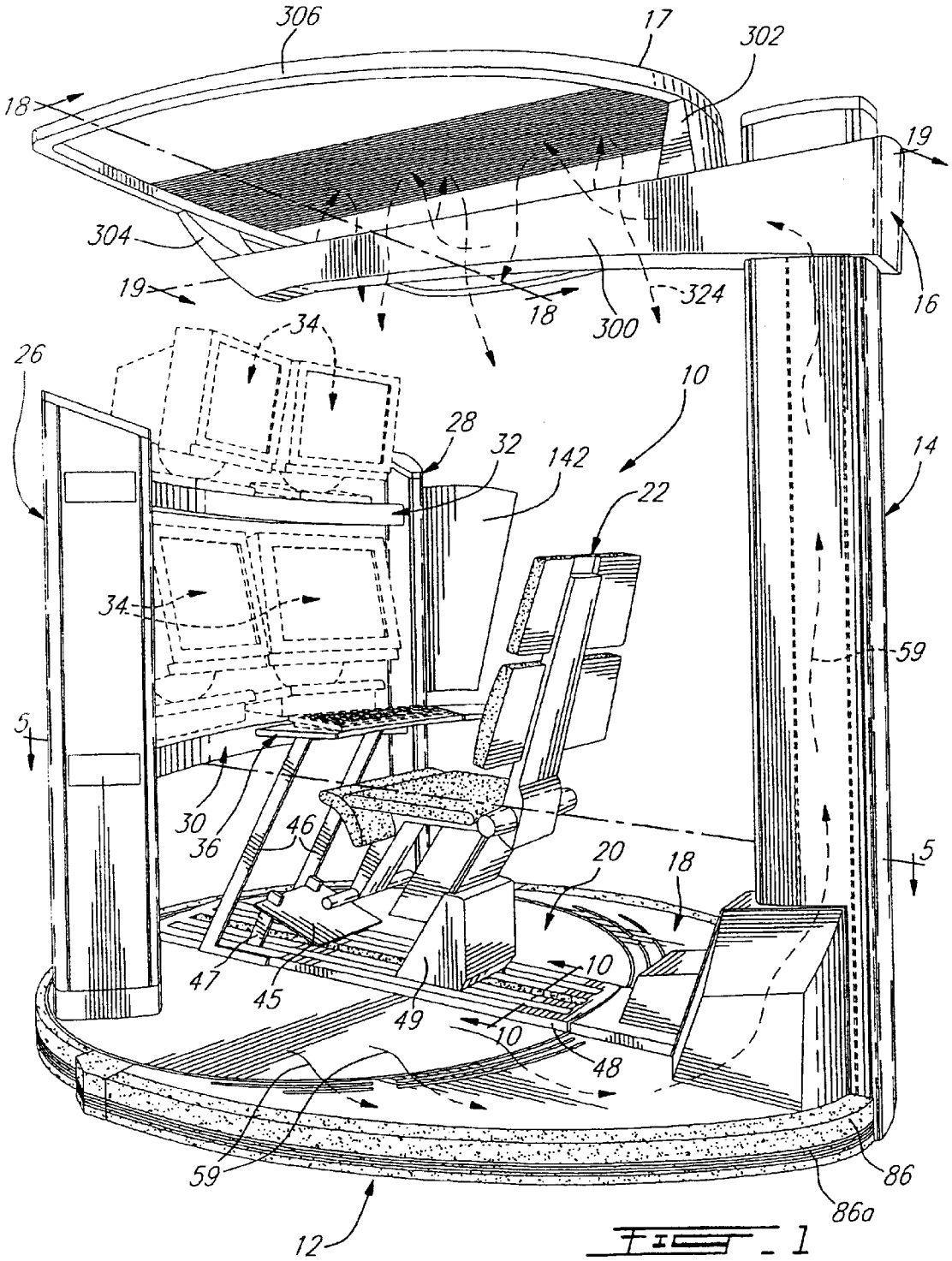
FIG. 1 is a perspective view of a self-contained activity module made in accordance with the present invention.
Figure 2:
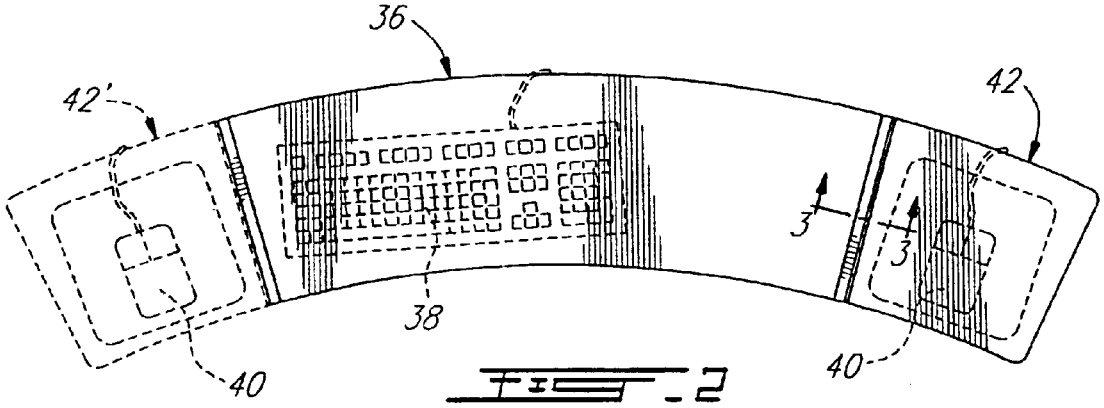
FIG. 2 is a top plan view of a work surface and attachment.
Figure 3:
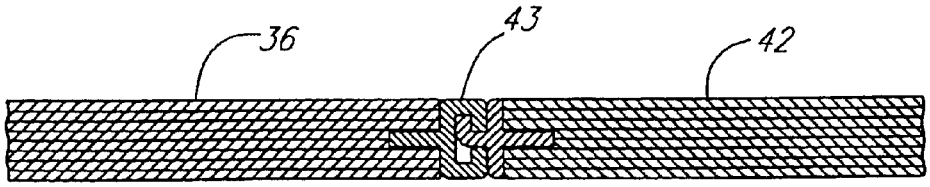
FIG. 3 is a cross-sectional view taken along lines 3—3 of FIG. 2.

Referring to FIG. 1, there is shown a self-contained activity module comprising a work area, generally denoted 10, on which work area 10 rests, a rear vertical service housing and distribution unit 14 extending from the base assembly 12, a top service housing and distribution unit 16 extending horizontally from unit 14 and over the work area 10, and a canopy member 17, which is positioned on and supported by unit 16. The base assembly 12 defines a generally oval shape and comprises a fixed tail section 18. A rotatable disc 20 is pivotably mounted on the base assembly. A seating unit, generally denoted 22, is mounted on the rotatable disc 20. The work area 10 further includes a plurality of vertical and horizontal service housing and distribution units in the form of vertical columns 26 and 28 and horizontal supports 30 and 32, which interconnect 26 and 28. Each of units 26, 28, 30 and 32 house and distribute at least electrical services in the work area 10. Instead of the equipment support and services distribution structure formed by units 26, 28, 30 and 32, the work area could alternatively include a single column with one or more shelves attached to one or both sides thereof. Further, while FIG. 1 shows four computer display monitors 34 positioned on the horizontal supports 30 and 32, the supports are adapted to receive and support a full range of electronic equipment and/or storage devices. Referring also to FIGS. 2 and 3, the work area 10 comprises a working surface 36 for supporting a keyboard 38 and like equipment as well as a side surface 42 (or 42') for supporting a mouse or like equipment. Referring also to FIG. 2, there is shown a plan view of a possible configuration for work surface 36 wherein an additional surface 42 is provided to support a mouse or the like, which surface's position can be adjusted in relation to surface 36 and which can be disposed on either the left or right side of surface 36 to accommodate both left handed and right handed users.

Figure 4:
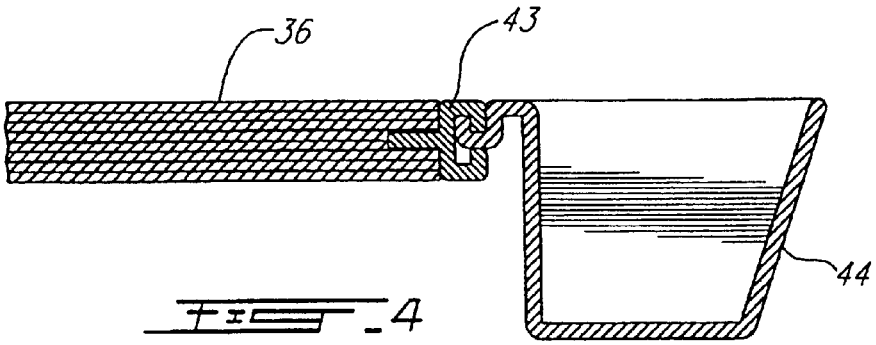
FIG. 4 is a cross-sectional view similar to that of FIG. 3, but showing another attachment.

Referring to FIGS. 3 and 4, two illustrations of an accessory mounting means is illustrated wherein the accessory items 42 and 44 respectively comprise a flange at one end that is demountably engaged with the "T" shaped channel of track member 43 carried on either a vertical service housing and distribution unit such as 14, 26, or 28 of FIG. 1, or on the underside of a horizontal service housing and distribution unit such as 30 of FIG. 1. A further description of this equipment support and positioning feature is provided in connection with FIGS. 11, 12, and 13.

The working surface 36 has a pair of legs 46 which, together with legs 47 of a foot rest 45, may be displaced along a track assembly 48 mounted to the disc 20. Also, the seating unit 22 has a base portion 49 adapted to travel along the track assembly 48. The assembly adjustably positions the seating unit 22, foot rest 45, and working surface 36, and permits the independent backward and forward movements of them along at least a portion of its length.

The seating unit 22, the working surface 36 and the foot rest 45 are equipped with appropriate means including electronic controls (not shown) to provide a full range of adjustment for affording maximum comfort to the occupant. In the case of the seat, such adjustments include, but are not limited to, those for height, tilt, lumbar support position and degree, swivel, dorsal angle and distance from other equipment. The working surface 36 is provided with adjustability for height, distance from other equipment, tilt and swivel. In connection with the issue of adjustment of various features of the activity module, in the preferred embodiment the module is provided with electronic controls operated by the user from a conveniently positioned control panel (not shown). The electronic controls are of standard types that will be familiar to those skilled in the art and include programmable memory capabilites. In addition, the controls are programmed such that when the module has not been in use for a given period environmental services such as temperature, air flow rate, and lighting level will automatically adjust to an energy saving mode. An occupancy sensor of any suitable type, for example photoelectric or pressure activated devices, may be used.

Figure 5:
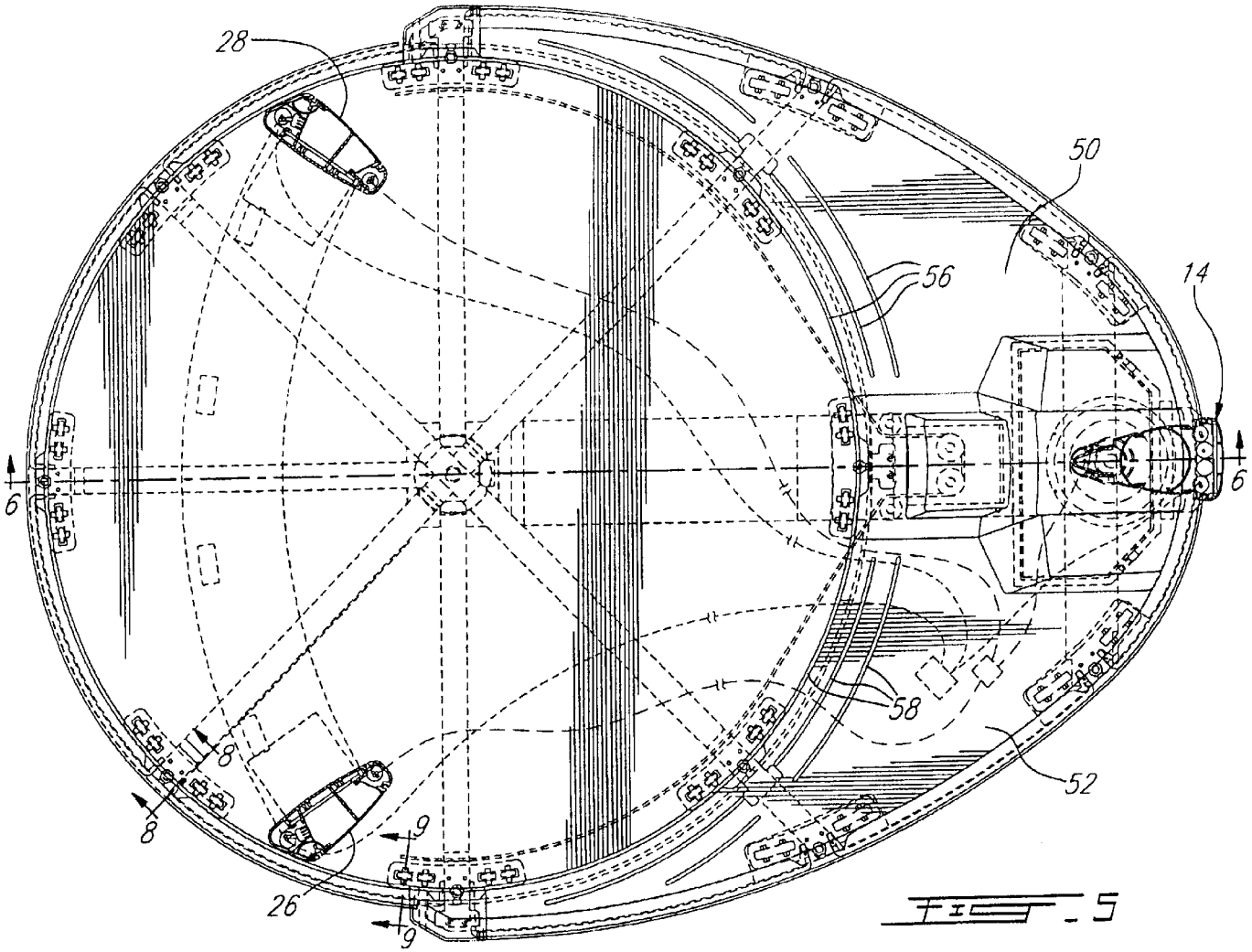
FIG. 5 is a top plan of the base assembly as seen from lines 5—5 of FIG. 1.
Figure 5:
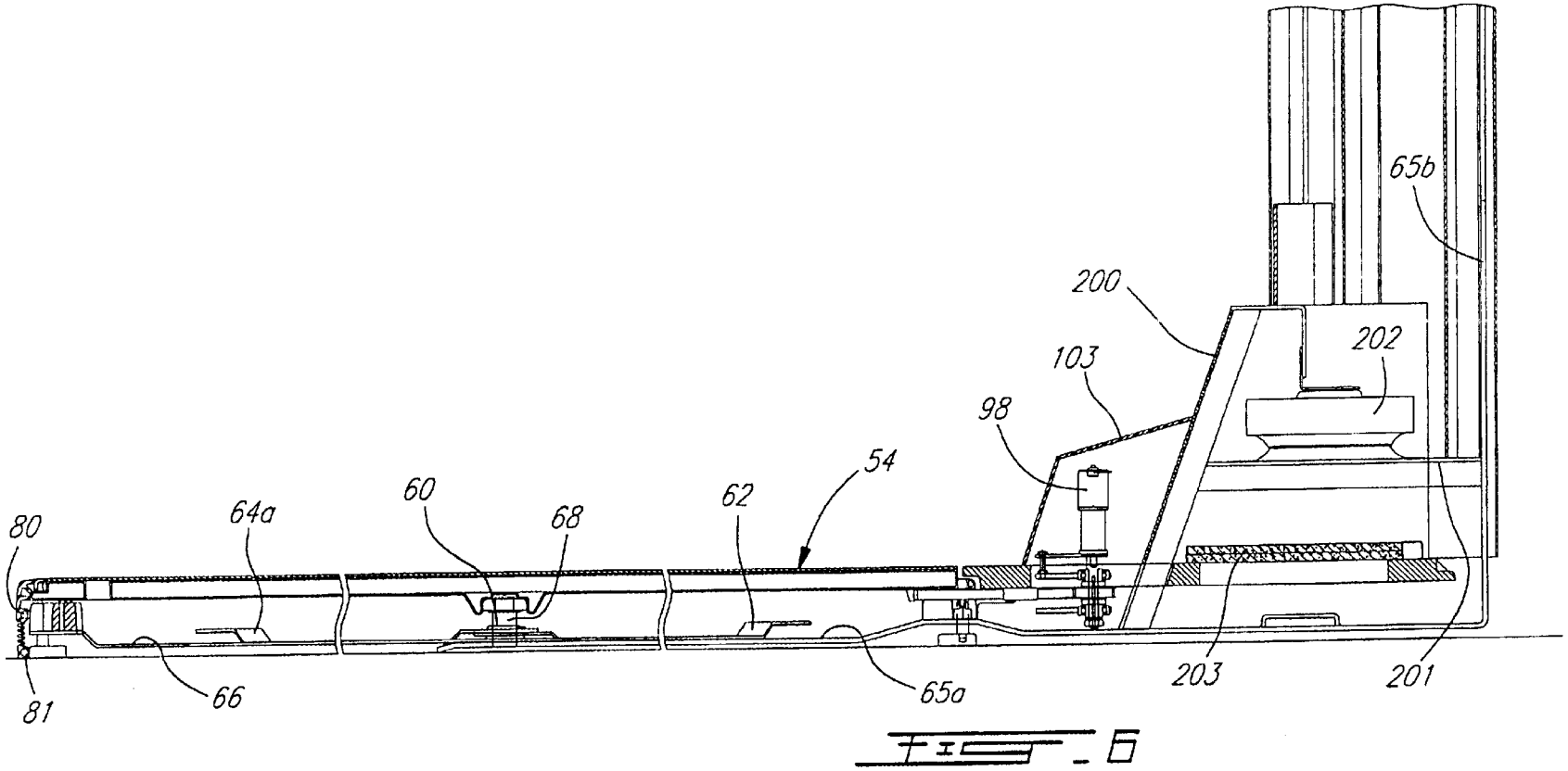
Figure 7:
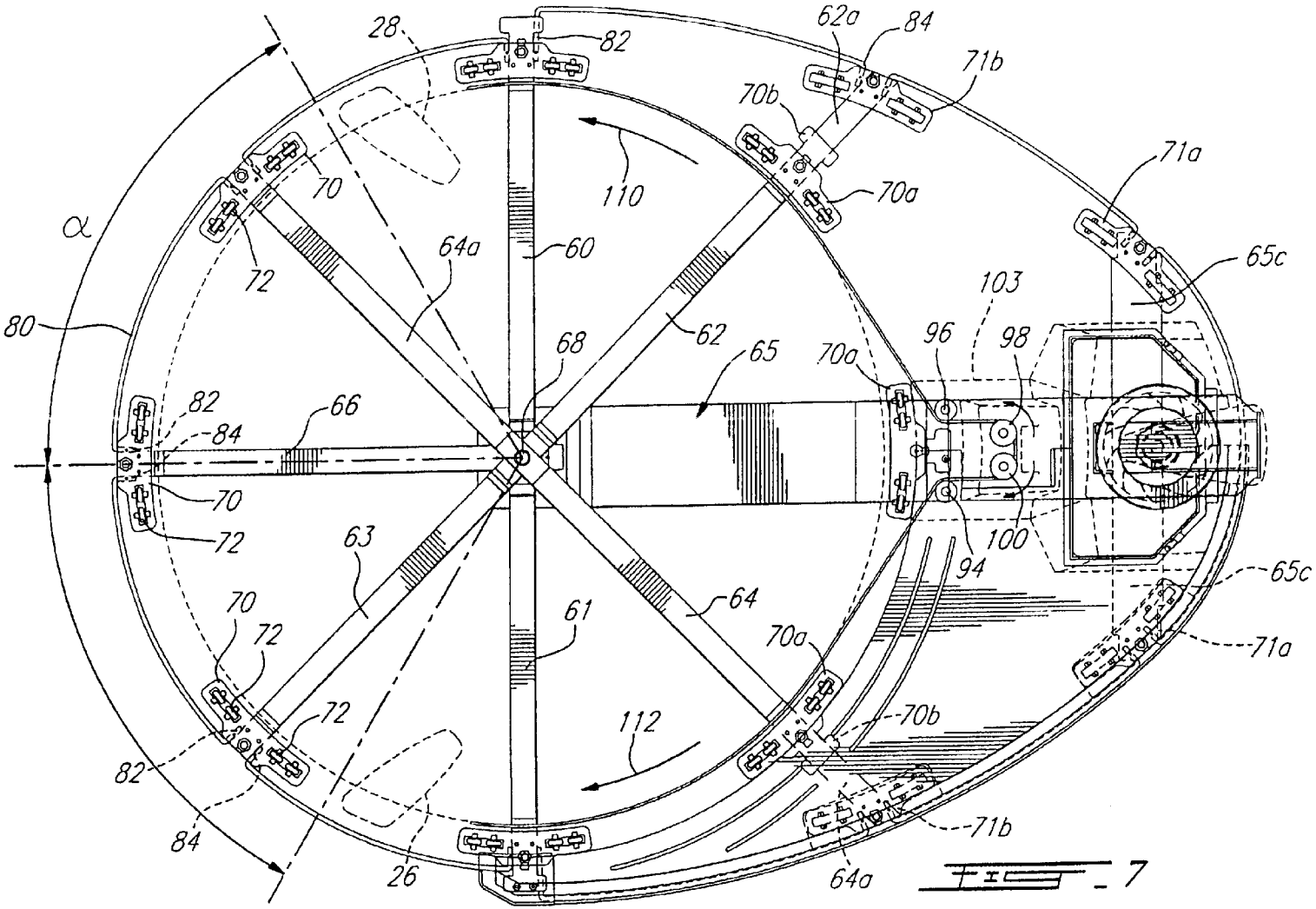
FIG. 7 is a top plan view similar to that of FIG. 5 with some top portions of the base assembly removed.

Referring to FIGS. 5 and 6, the tail section 18 of the base assembly 12 includes a pair of covering surfaces 50 and 52, each displaying a plurality of curved openings 56 and 58 allowing air to be drawn through and under the surfaces as illustrated by arrows 59 in FIG. 1 and as described further hereinbelow. Referring also to FIG. 7 (wherein surface 50 and disc 20 have been removed for illustration purposes), the under structure of the base assembly comprises a series of spacer arms 60, 61, 62, 63, 64, 64*a* and 66 extending radially of the base and connected at their centers to a hub member 68. To the outer end of each arm is mounted a levelling support member 70 in which is provided a series of rollers 72. A spacer and support beam 65 includes a perpendicular horizontally extending spacer arm 65*a* and a vertically extending perpendicular section 65*b* that passes through portions of surfaces 50 and 52 and supports the service housing and distribution unit 14. Spacer and support beam 65 also supports a levelling support member 70 provided with rollers 72. Support members 71, which are support arms without rollers, are positioned in the tail section of the base assembly below surfaces 50 and 52. Levelling support members 71*a* are connected through spacer arms 65*c* to beam 65. One of the levelling support members 71*b* is connected through spacer arm 64*a* to one of the members 70*b*, while the other member 71*b* is connected through spacer arm 62*a* to the other member 70*b*.

Figure 8:
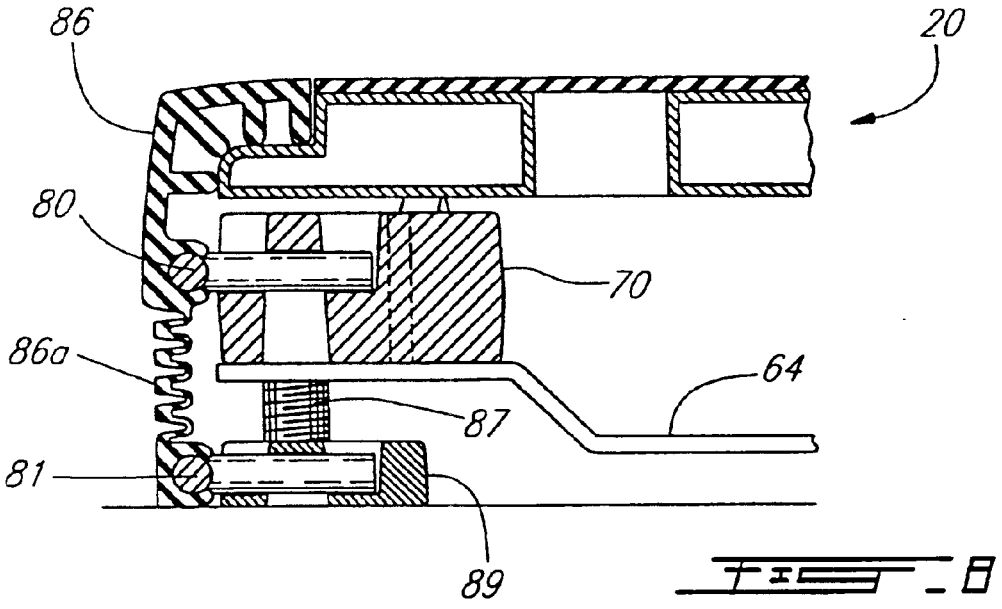
FIG. 8 is an enlarged cross-sectional view taken along lines 8—8 of FIG. 5.
Figure 9:
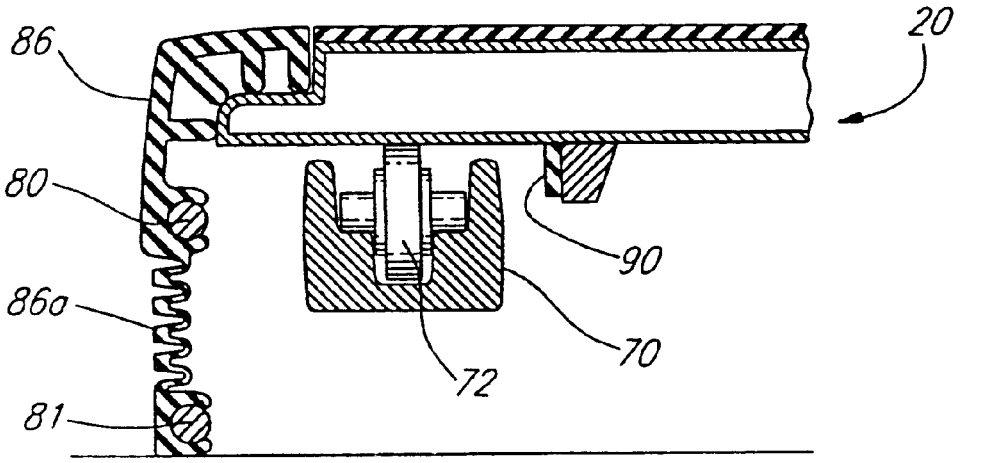
FIG. 9 is an enlarged cross-sectional view taken along lines 9—9 of FIG. 5.

As illustrated in FIGS. 6 and 7, a pair of arcuate pieces or rods 80, 81 is disposed at peripheral sections of the base; each arcuate piece 80 has in-turned bent ends 82 and 84 that are engaged in the roller housings of 70 and 71. As illustrated in FIGS. 8 and 9, a side covering 86, made of resilient material, is snapped into engagement with the arcuate pieces 80 and 81 to conceal and seal the under structure of the base. These side covers have an extensible intermediate portion 86*a* allowing for a vertical adjustment which is accomplished by rotating the levelling screw 87 extending between the arms and a floor contacting support plate 89. The support plate 89 may also serve as a glide for moving the module to another location. Other means such as, for example, separate glides, wheels, casters, bearings or the like may be included in the base assembly for this purpose.

The rotation of the disc 20 is accomplished by the actuation of a band 90 which is fixed, at its extremities 90*a* and 90*b*, to the disc and which bears against a downwardly projecting segment 92 of the under surface of disc 20 (see FIG. 9). In the tail section 18 of the base assembly, the band passes through a series of rollers 94 and 96 which are driven by one or two motors 98 and 100. These motors, which are housed under a cover 103, cause the rotation of the disc 20 in both directions as indicated by arrows 110 and 112 so that the work area 10 may be rotated within an angle range $\alpha$ (see FIG. 7) which is preferably between 0° and 60°. Using standard electronic controls the disk can be programmed to automatically rotate at a given rate over a given period, and/or may be controllable by the work station's occupant. Moreover, the disc's rotation means may allow the user to rotate and position the disc manually.

Figure 10:
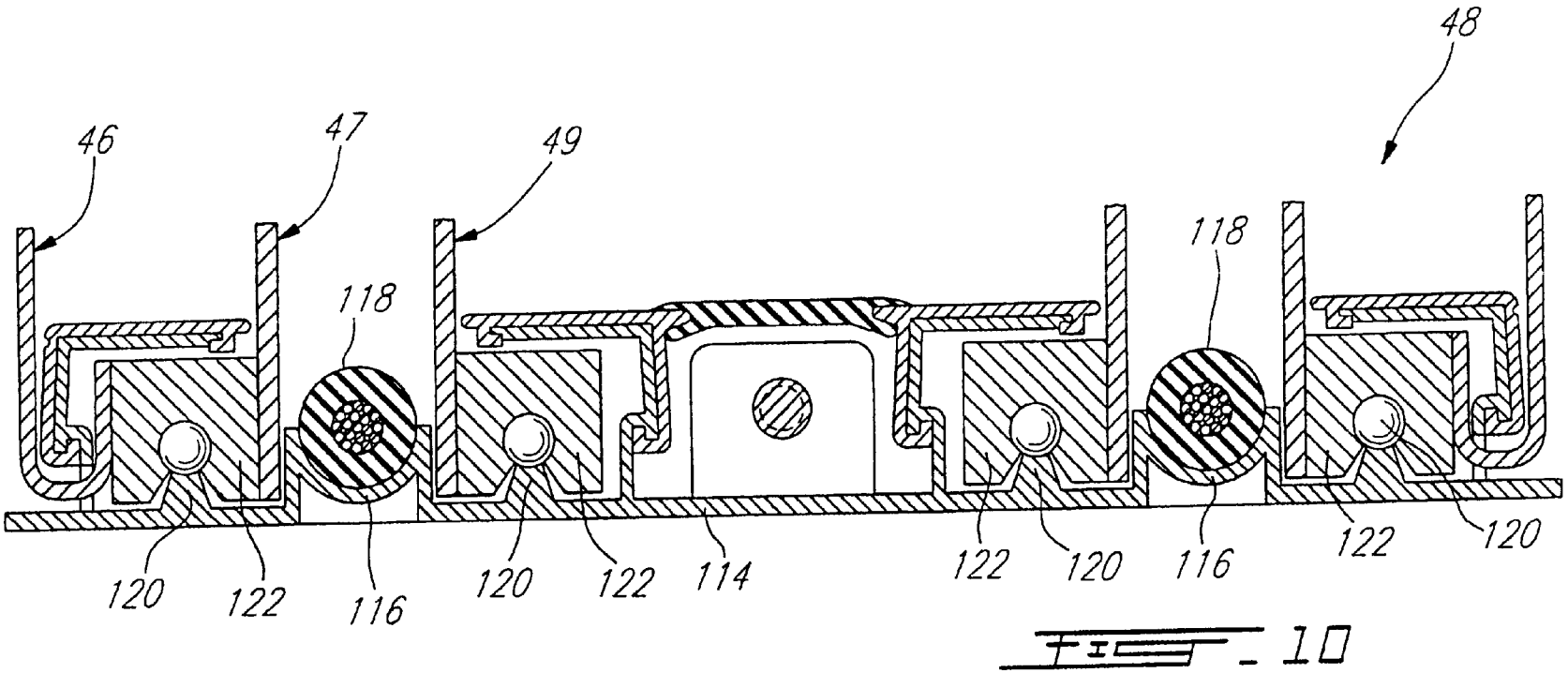
FIG. 10 is a cross-sectional view taken along lines 10—10 of FIG. 1.

FIG. 10 is a cross-sectional view of the track assembly 48; it comprises a base plate 114 having a series of concave areas 116 to receive conductors 118 for electricity and a plurality of roller bearing supports 120 cooperating with a series of bases 122 to which are connected the legs 46, 47 or the base 49 of the seating unit 22.

Figure 11:
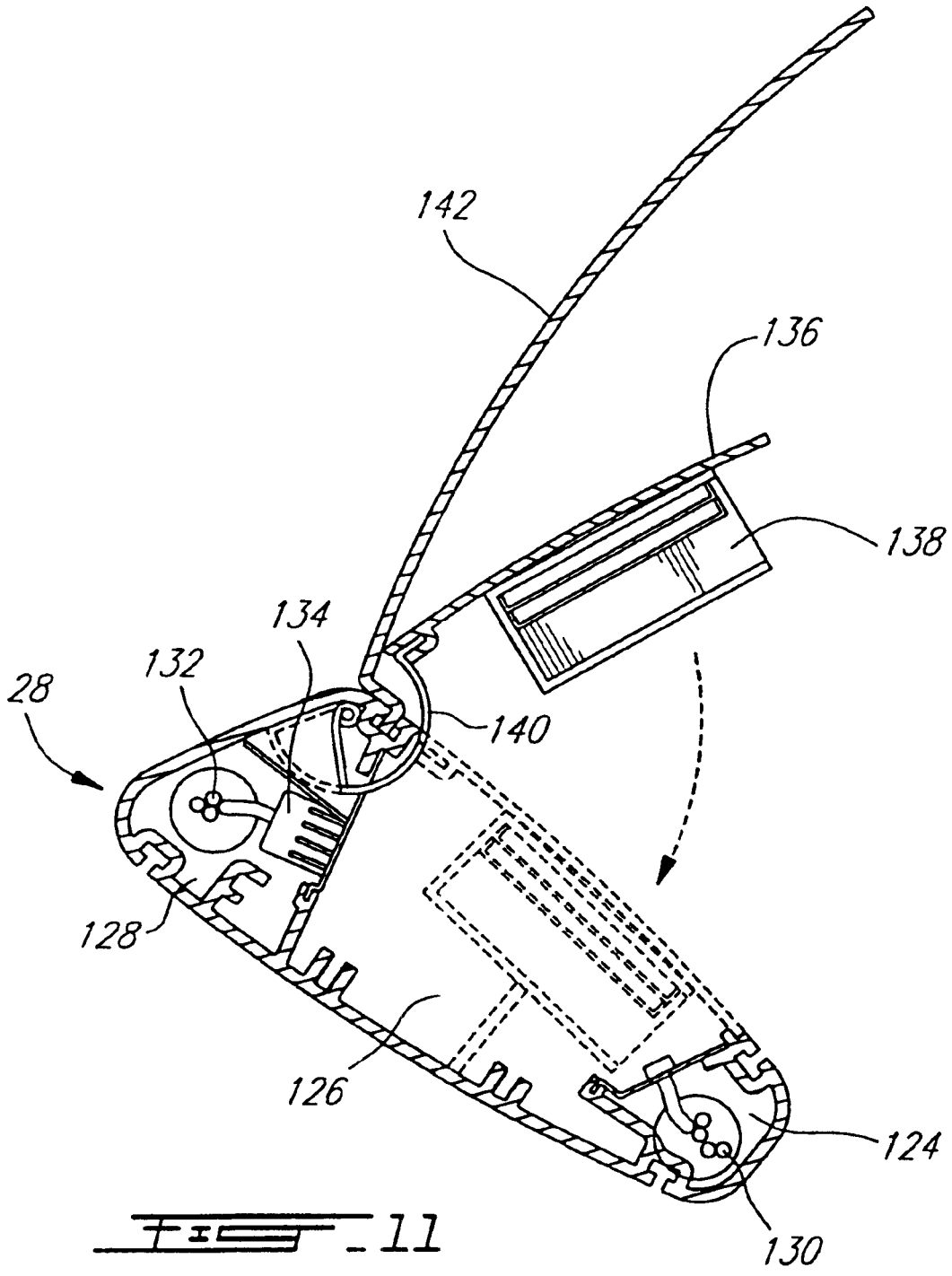
FIG. 11 is a cross-sectional view showing the construction of a column with door and privacy screen attachments.
Figure 12:
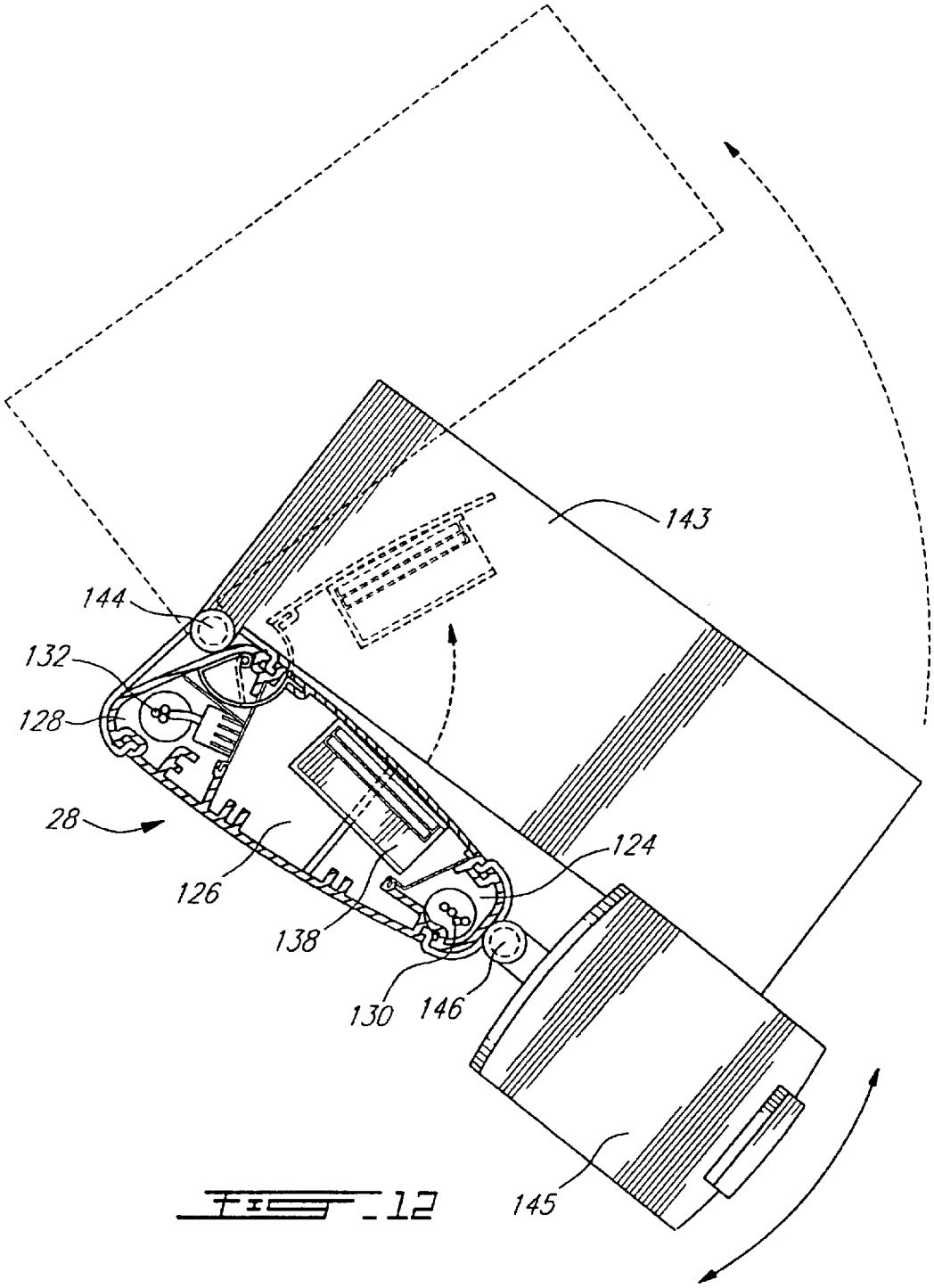
FIG. 12 is a cross-sectional view showing the column construction with support surface attachments.

FIGS. 11 and 12 show the construction of a service housing and distribution unit as represented in vertical columns 26 and 28. Defined therewithin are three separate chambers 124,126,128; chamber 124 may house signal cables 130 and connectors therefor to service the electronic components of the work module while chamber 128 may serve to house power wiring 132 and connectors 134 therefor. A unit, as represented by 26, 28, includes side door panels (one of which is shown as 136) which open to provide access to the unit's interior passages. The doors are adapted to provide convenient storage for CD's diskettes, and the like and a storage device, such as a disc container 183, may be housed in chamber 126. The door panel 136 is hingedly connected at 140 to units 26, 28. Additionally, both vertical and horizontal service housing and distribution units may be provided on their exterior surfaces with a track 141 adapted to receive and hold accessory items in place. An example of this is illustrated in FIG. 11 wherein one of the track members, each of which has a "T" shaped channel, is shown engaging the "T" shaped end portion 142*a* of a demountable privacy screen 142. While a specific channel and engaging member profile is depicted here, it is of course possible to use any suitable configuration, and further, other means for supporting or suspending equipment from the service housing and distribution units may be used, such as hooks inserted in slots, keyways, brackets, braces, and the like.

Figure 13:
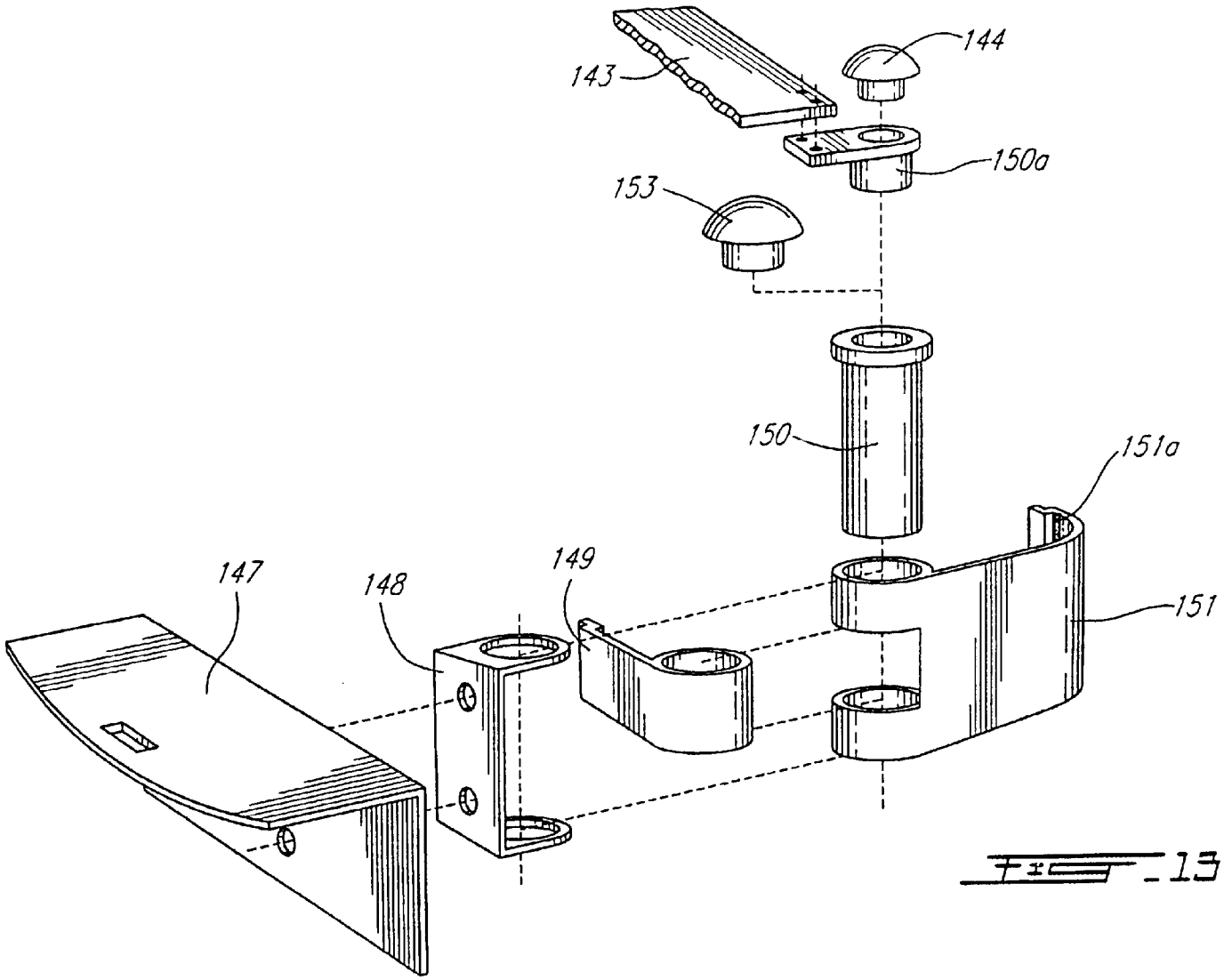
FIG. 13 is an exploded view of a connection means to the column structure of FIG. 12.

FIGS. 12 and 13 illustrate a particular support assembly used in conjunction with a vertically extending track as described above and intended to hold a computer tower or like equipment. As shown in exploded view 13 the assembly comprises a lower plate support 147 which receives the bottom of a computer tower (not shown). Plate 147 pivots about a pin 150 and is connected thereto through a series of components 148, 149, and 151. Component 151 has a curved portion 151*a* profiled to fittingly connect with the surface of the front vertical service housing and distribution units 26 and 28. Component 151 also has an edge with a "T" profile for insertion into the "T" shaped channel of track 141. A pivot cap 153 is used to cover the pivot pin 150. Where desired, the assembly will also provide additional support at the top of the computer tower wherein the horizontally extending portion of an upper plate support 147 extends over a portion of the top of the tower. Where equipment such as additional drives are used, the assembly may further include an upper surface 143, the edge of which is positioned and held on the horizontal lip of 150*a*. Where this additional surface is provided a pivot cap 144 is used in place of 153. Top surface 143 pivots independently of the tower support assembly disposed below it.

Referring to FIGS. 6, 14, 15 and 16, the rear vertical service housing and distribution unit 14 comprises, a column structure 204 which is supported on the vertically extending perpendicular section 65*b* of spacer and support beam 65. Section 65*b* houses a fan 202 allowing air to be drawn through the curved openings 56 and 58 of surfaces 50 and 52 as mentioned above. Section 65*b* also houses filter 203 and septum 201. The air passes through a filter 203 and is directed to the fan 202 after having been converged through the septum 201. The rate of air flow into and through the work area 10 is controlled by the occupant using standard electronic or damper controls (not shown) provided in the module. The module's air distribution system may further include a heating coil allowing for temperature control by the occupant through that means, or a separate radiant heat panel or strip, also adjustable by the occupant using controls of types familiar to those skilled in the art. Unit 204 further includes three interior passages 206, 208 and 210 allowing for the selective passage of air, electrical power, signal cables, fiber optics, and the like.

Figure 14:
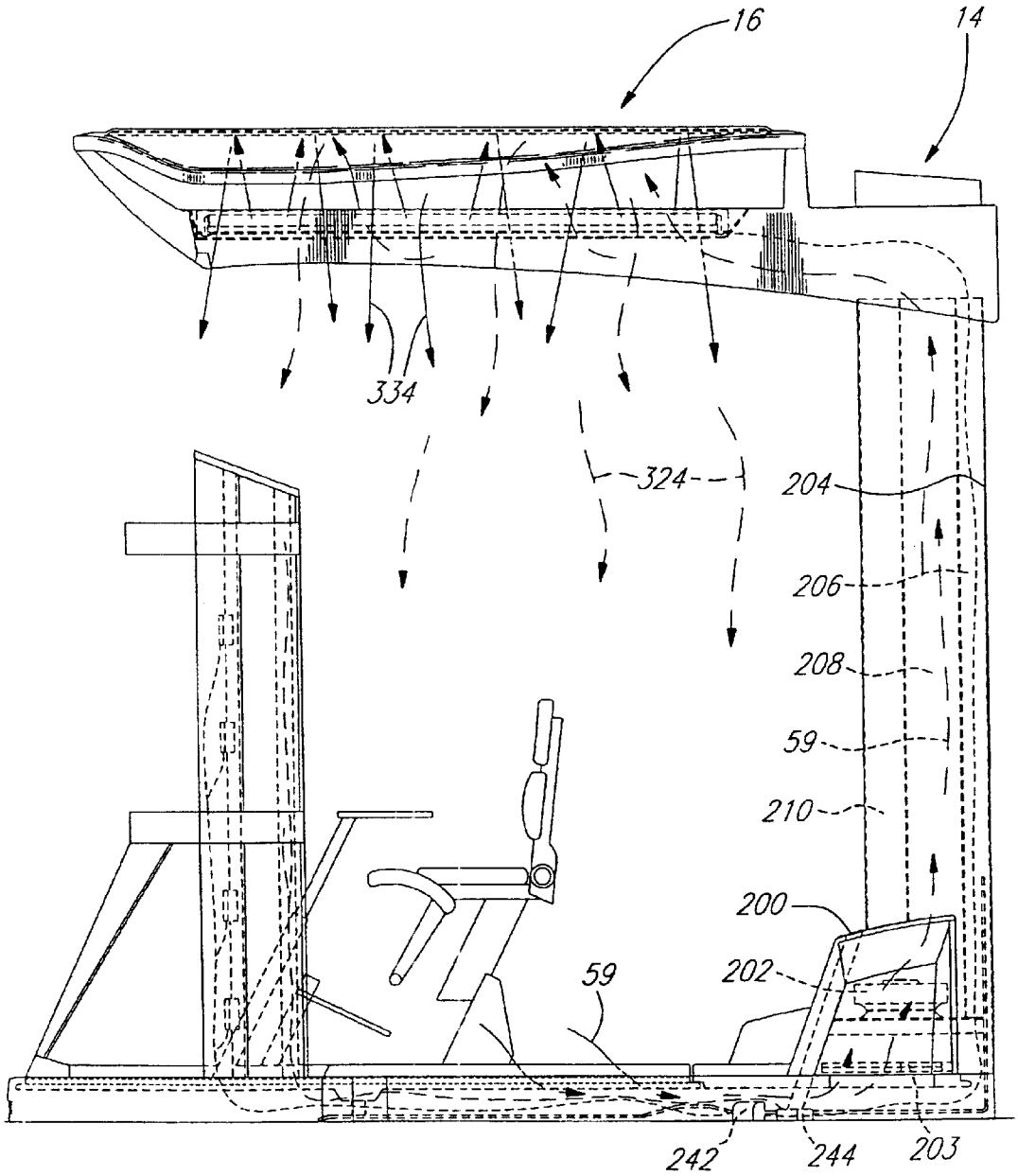
FIG. 14 is a schematic elevation of the module showing electrical supply originating at floor level.
Figure 15:
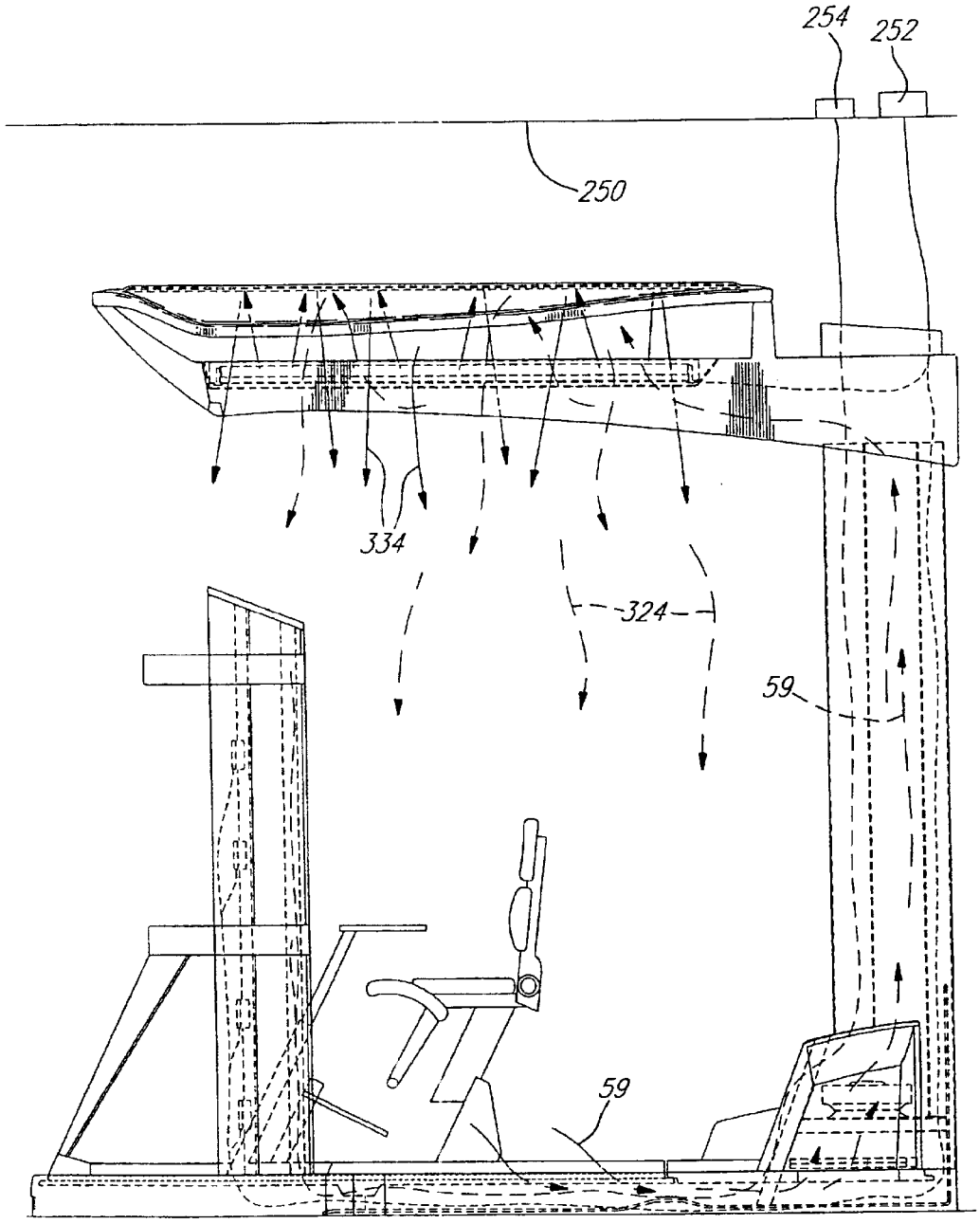
FIG. 15 is a schematic elevation of the module showing electrical supply originating at ceiling level.

FIG. 14 shows how electrical services are brought into the module when they are supplied from the floor level of a building. In such case, connections are made to connector boxes 242 and 244, which are disposed under the base assembly. FIG. 15 illustrates how electrical services are brought into the module when they are supplied from the ceiling level 250 of a building. In such case, the supply connection is made to connector boxes 252 and 254 disposed in the ceiling space. In both figures, arrows 59 indicate air flow through the module's air passages and the work environment.

Figure 16:
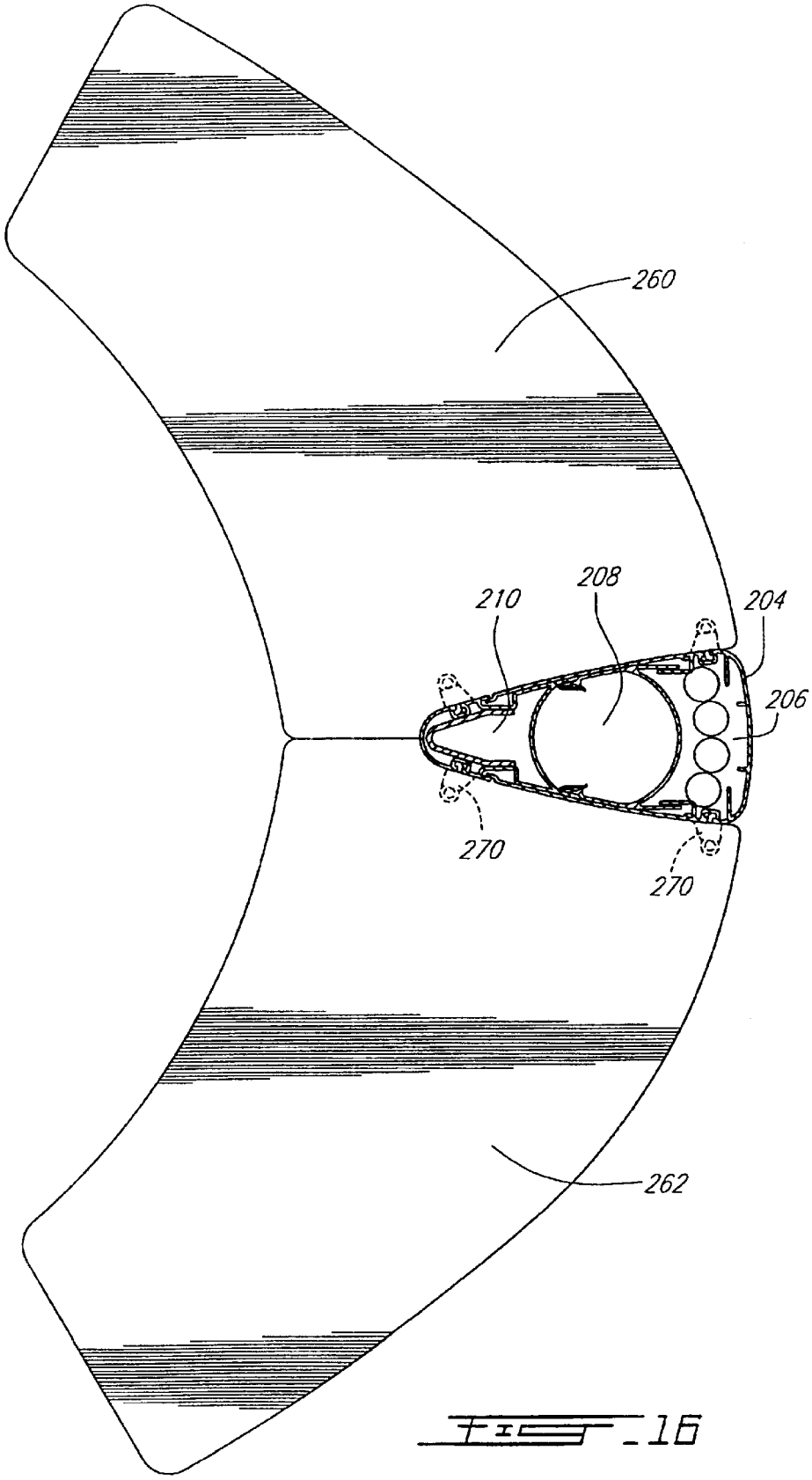
FIG. 16 is a cross-sectional view of the rear column with work surface attachments.
Figures 17, 20:
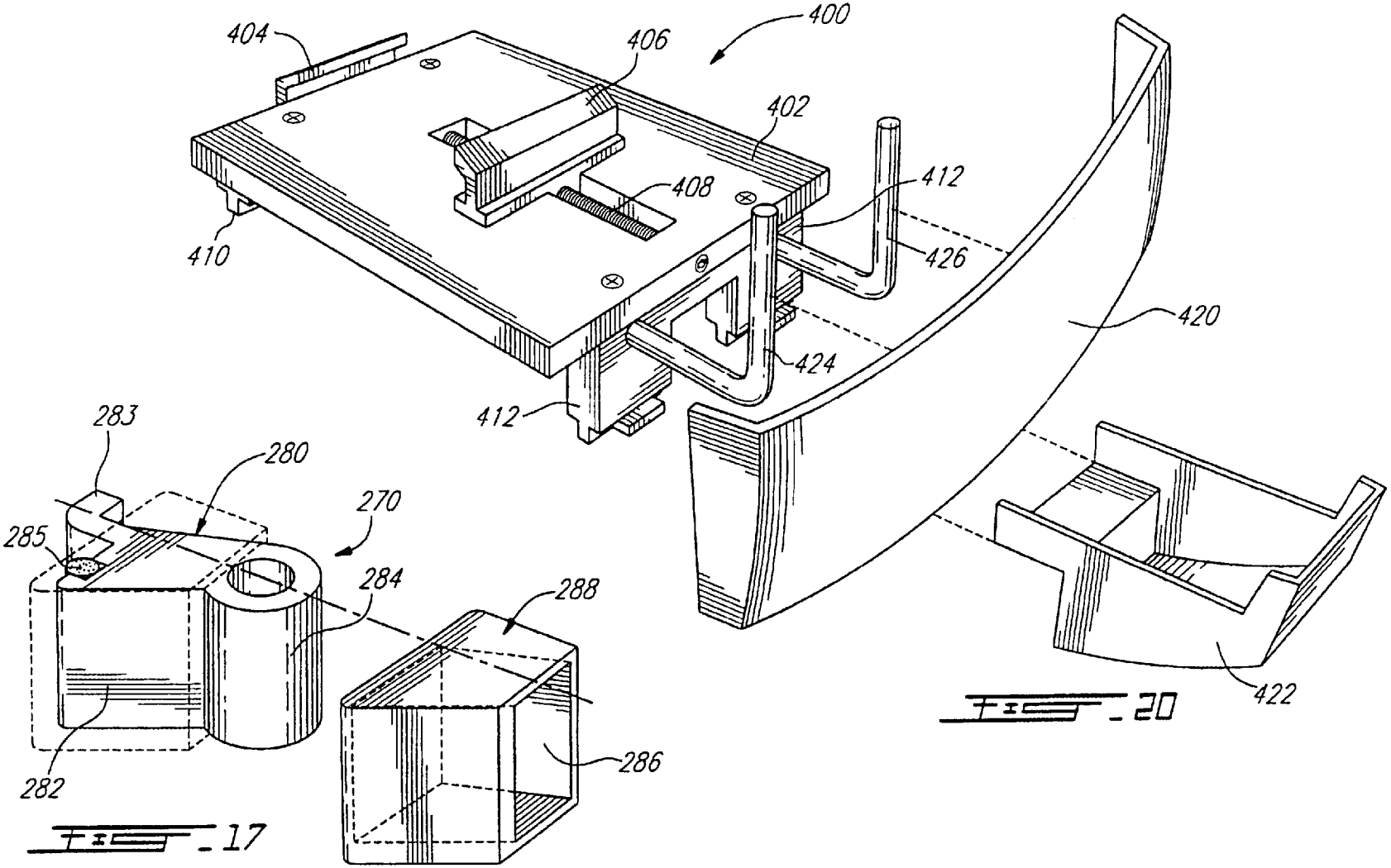
FIG. 17 is an exploded view of a connection device of the attachment of FIG. 16 to the column.
FIG. 20 is an exploded view of a support device for the display monitor.

FIG. 16 illustrates a pair of work surfaces 260 and 262 mounted to the rear vertical service housing and distribution unit 14 by means of a series of brackets 270, the construction of which brackets is illustrated in FIG. 17. The bracket consists of a first component 280 having a generally rectangular portion 282 and a flange portion 283 extending therefrom, portion 282 further includes a "U" shaped channel which receives a vinyl "O" ring 285. The flange 283 engages the "T" shaped channel of the track positioned on unit 14, which is of the same configuration as that illustrated in FIGS. 3, 4, and 11. A second component 288 having an opening 286 is received by component 280 and forms a snug fit therewith. After being engaged in the track carried on unit 14 the brackets 270 receive and support on their upwardly directed surfaces portions of the undersides of work surfaces 260 and 262. Further, on the undersides of work surfaces 260 and 262 there are disposed downwardly extending rods (not shown) that are inserted into and engage the cylindrical channel 284 of each bracket 270.

Figure 18:
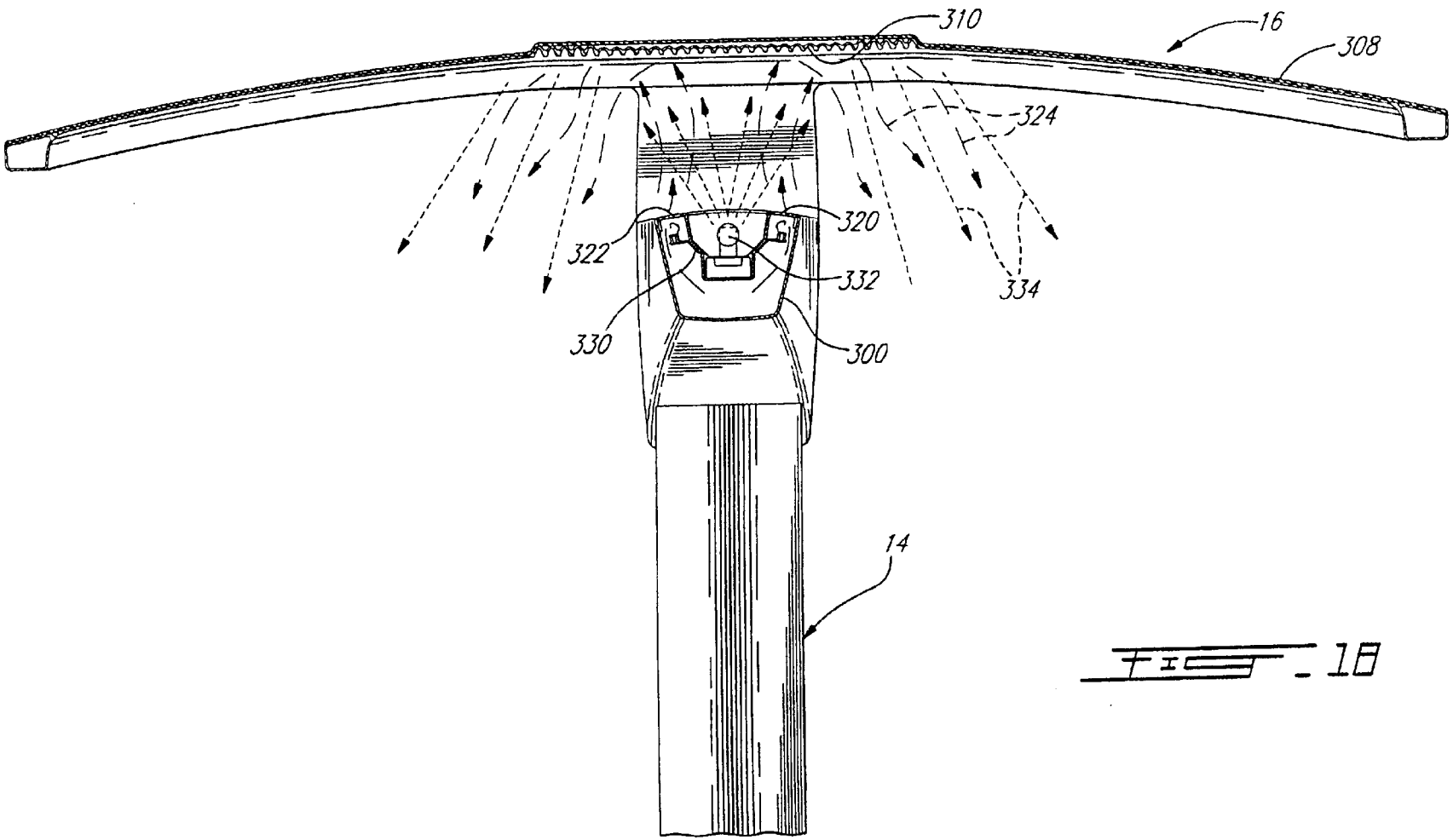
FIG. 18 is a cross-sectional view taken along lines 18—18 of FIG. 1 and show distribution of air and light.
Figure 19:
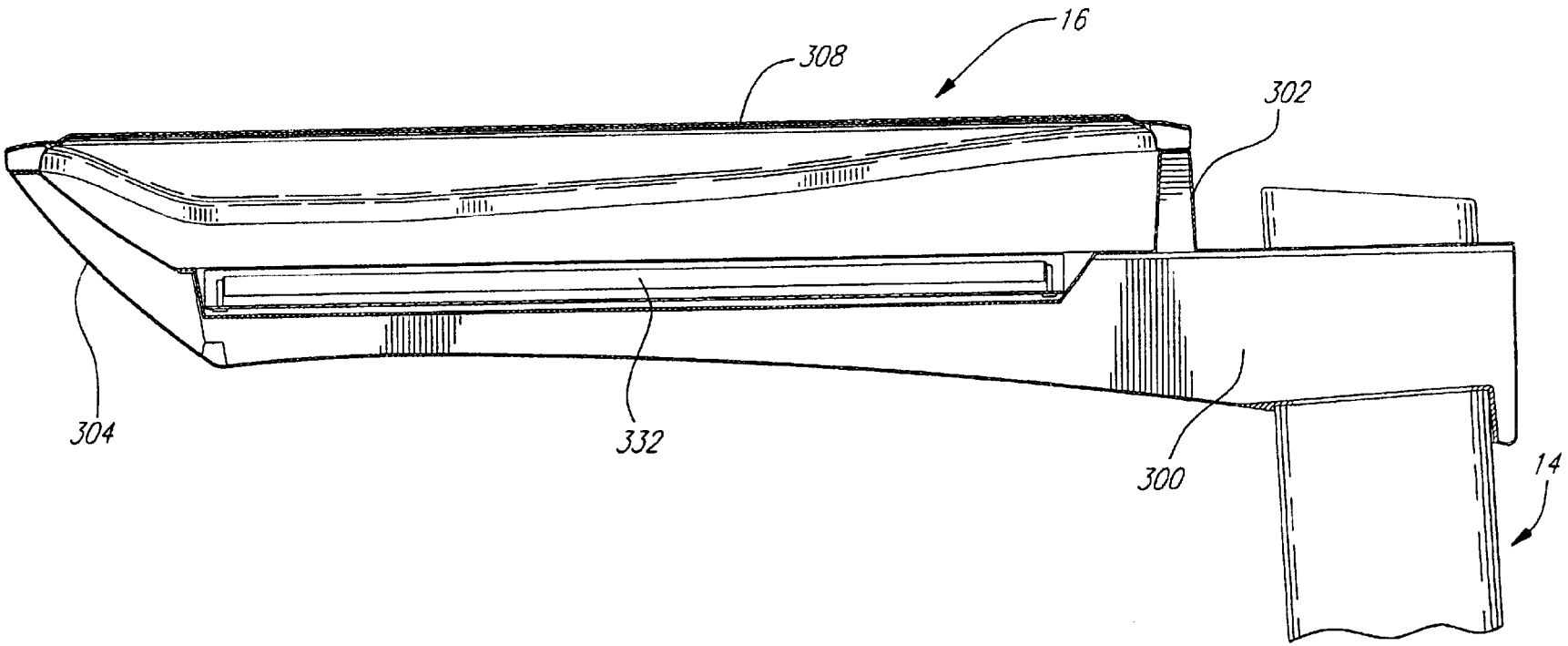
FIG. 19 is a cross-sectional view taken along lines 19—19 of FIG. 1.

Referring to FIGS. 1, 18 and 19, the upper service housing and distribution unit 16 consists of an elongated horizontal beam bearing a pair of end members 302 and 304 for supporting an overhead canopy 306 that has a concave wall 308 with a corrugated central area 310 on the underface thereof. Beam 16 has an air passage in fluid communication with the air passage 208 of the service and distribution unit 14 and has on its upper surface, a pair of rows of longitudinally spaced openings 320 and 322 allowing air to be directed upwardly from the air passage to contact wall 308 and downwardly into the work area 10 as indicated by arrows 324 in FIGS. 1, 14 and 15. Unit 16 also includes an inner enclosure 330 with a light source 332 the light from which is reflected by the canopy wall 308 to the work area as indicated by arrows 334 in FIGS. 14 and 15. The canopy also serves to shield sound in the vicinity of the module. The light source provides indirect ambient lighting to the work area 10. Separate task lighting may also be provided if desired. The lighting level is adjustable by the occupant using standard dimmer type controls that will be familiar to one skilled in the art.

FIG. 20 shows an adjustable positioning and support device 400 for positioning and supporting display monitors such as 34 on a horizontal surface. This device comprises a plate 402 having a pair of clamping device 404 and 406, the latter being adjustable through an actuatable screw 408. The undersurface of the plate 402 has leg supports 410 at one end and 412 at the other end, the leg supports being of different heights to give an inclination to the monitors 34 on the horizontal shelf surfaces provided by units 30 and 32. By placing the positioning and support device in one way on the surface the monitors are inclined as shown on unit 30 and, if placed in the opposite way, the monitors will be inclined as shown on unit 32. A pair of covers 420 and 422 are snapped in engagement with a pair of rods 424 and 426 and serve to hide electrical conductors supplying the monitors 34.

Although the invention has been described above with respect to some preferred forms of the invention, it will be evident to a person skilled in the art that it may be modified and refined in various ways. It is therefore wished to have it understood that the present invention should not be limited in interpretation, except by the terms of the following claims.

What is claimed is:

1. A self-contained activity module comprising a base assembly adapted to be positioned on a floor, a first service housing and distribution unit positioned on said base assembly and extending substantially vertically upward therefrom, said first service housing and distribution unit including walls forming at least one vertical service passage, and a second service housing and distribution unit cantilever-positioned on said first service housing and distribution unit and substantially perpendicular thereto, said second service housing and distribution unit extending substantially horizontally over at least a portion of said base assembly and spaced apart therefrom, said second service housing and distribution unit including walls forming at least one horizontal service passage positioned in fluid communication with said vertical service passage; wherein a rotatable disc is pivotably mounted on said base assembly including an electric motor for rotating said disc.

2. A self-contained activity module as defined in claim 1 wherein an upper surface of said rotatable disc is provided with means for adjustably locating and retaining a seating unit.

3. A self-contained activity module comprising a base assembly adapted to be positioned on a floor, a first service housing and distribution unit positioned on said base assembly and extending substantially vertically upward therefrom, said first service housing and distribution unit including walls forming at least one vertical service passage, and a second service housing and distribution unit cantilever-positioned on said first unit and substantially perpendicular thereto, said second service housing and distribution unit extending substantially horizontally over at least a portion of said base assembly and spaced apart therefrom, said second service housing and distribution unit including walls forming at least one horizontal service passage positioned in fluid communication with said vertical service passage;

wherein a rotatable disc is pivotably mounted on said base assembly;

wherein an upper surface of said rotatable disc is provided with means for adjustable locating and retaining a seating unit; and wherein said means for adjustably locating and retaining said seating unit is a track assembly.

* * * * *